US005778757A

United States Patent [19]

Kristensen et al.

[11] Patent Number: 5,778,757

[45] Date of Patent: Jul. 14, 1998

[54] HYDRAULIC AXIAL PISTON MACHINE

[75] Inventors: Egon Kristensen, Nordborg; Kurt Mamsen, Sønderborg, both of Denmark

[73] Assignee: Danfoss A/S, Nordborg, Denmark

[21] Appl. No.: 765,411

[22] PCT Filed: Jun. 30, 1995

[86] PCT No.: PCT/DK95/00280

§ 371 Date: Dec. 26, 1996

§ 102(e) Date: Dec. 26, 1996

[87] PCT Pub. No.: WO96/02759

PCT Pub. Date: Feb. 1, 1996

[30] Foreign Application Priority Data

Jul. 13, 1994 [DE] Germany ..... 44 24 608.0

[51] Int. Cl.[6] ..... F01B 3/00

[52] U.S. Cl. ..... 92/12.2; 92/57; 92/71; 417/269

[58] Field of Search ..... 2/12.2, 57, 71; 417/269

[56] References Cited

U.S. PATENT DOCUMENTS

| | | | |
|---|---|---|---|
| 5,017,095 | 5/1991 | Burgess et al. | 92/12.2 X |
| 5,588,347 | 12/1996 | Jepsen | 92/57 X |
| 5,622,097 | 4/1997 | Martensen et al. | 92/57 |
| 5,660,097 | 8/1997 | Nomura et al. | 92/12.2 |

*Primary Examiner*—Hoang Nguyen

*Attorney, Agent, or Firm*—Lee, Mann, Smith, McWilliams, Sweeney & Ohlson

[57] ABSTRACT

A hydraulic axial piston machine is disclosed, having a cylinder drum, which has at least one cylinder in which a piston is arranged to move back and forth, which piston bears by way of a slide shoe against a swash plate, wherein the cylinder drum and the swash plate are rotatable relative to one another, and a pressure plate, which holds the slide shoe in contact with the swash plate, is joined, articulated, to the cylinder drum by way of a ball-and-socket joint having a convexly spherical bearing surface. It is desirable for manufacture of such a machine to be simplified. To that end, the bearing surface is formed by a friction-reducing plastics material.

8 Claims, 1 Drawing Sheet

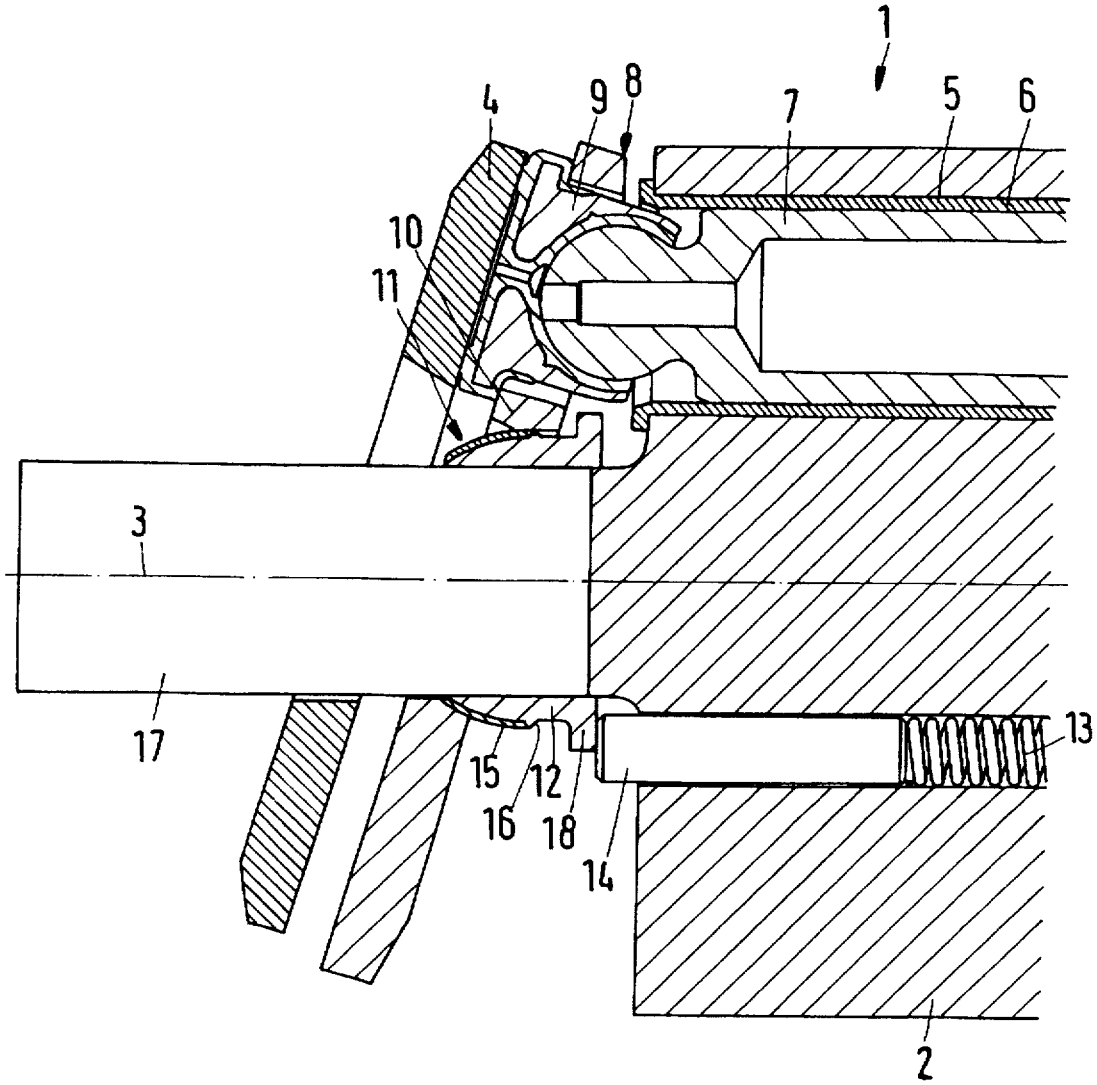
1
4
9
8
7
5
6
10
11
3
17
15
12
16
18
14
13
2

HYDRAULIC AXIAL PISTON MACHINE

BACKGROUND OF THE INVENTION

The invention relates to a hydraulic axial piston machine having a cylinder drum, which has at least one cylinder in which a piston is arranged to move back and forth, which piston bears by way of a slide shoe against a swash plate, wherein the cylinder drum and the swash plate are rotatable relative to one another, and a pressure plate, which holds the slide shoe in contact with the swash plate, is joined, articulated, to the cylinder drum by way of a ball-and-socket joint having a convexly spherical bearing surface.

In machines of that kind, on rotation of the cylinder body with respect to the swash plate or on rotation of the swash plate with respect to the cylinder body, the piston moves axially. During the pressure stroke, that is, on shortening of the cylinder moved by the piston, the swash plate exerts a pressure on the slide shoe. During the suction stroke on the other hand, the pressure plate has to hold the slide shoe in contact with the swash plate. Corresponding to the axial back and forth movements of the piston, the pressure plate has to tilt back and forth, the tilting angle range extending, for example, from about −15° to about +15°. On each rotation, the pressure plate has to pass through the entire tilting angle range once in the positive direction and once in the negative direction.

A machine of the kind mentioned in the introduction is shown, for example, in DE 39 01 064 A1.

Since the articulated connection between the cylinder body and the pressure plate has to absorb considerable forces, considerable friction occurs here. So that the losses caused by the friction and the wear and tear are not allowed to become too great, it is known to lubricate this articulated connection. For that purpose the oil already present, which serves as hydraulic fluid, is usually used. But this leads to the disadvantage that one is restricted in one's choice of hydraulic fluids to hydraulic oils. Even here, choice is not without restriction since not all oils have the same good lubricating properties. In the past there has therefore been an increasing change-over to the use of synthetic oils, but these are being regarded with increasing criticism from the point of view of their compatibility with the environment.

In order also to be able to use a hydraulic fluid having relatively poor or no lubricating properties, such as water, for example, the prior German patent application P 43 01 121 describes a machine in which an insert of a friction-reducing plastics material is inserted in the pressure plate and is supported radially and axially by the pressure plate. This insert lies against a counterpart, which in turn bears against the cylinder drum. Although this arrangement has proved successful when operated with water as the hydraulic fluid, it requires relatively complicated machining of the pressure plate. The contact surfaces for the insert piece have to be created.

SUMMARY OF THE INVENTION

The invention is based on the problem of simplifying the manufacture of a hydraulic axial piston machine which is intended to be suitable for non-lubricating hydraulic fluids.

This problem is solved in a machine of the kind mentioned in the introduction in that the convexly spherical bearing surface is formed from a friction-reducing plastics material.

Although, here, a pairing of materials between a friction-reducing plastics material and a harder material, of which the pressure plate must consist, for example, iron or steel, still obtains, the low friction that is a condition here for operation with a liquid having no lubricating properties is achieved in this case by the design of the spherically convex bearing surface. It is there that the plastics material that effects the reduction in friction is found. The pressure plate now no longer needs to be machined, that is, no additional contact surfaces have to be produced. On the contrary, the pressure plate can be constructed in the manner known from the state of the art. Moreover, the advantage is gained that machining of the spherically convex surface becomes simpler as well. As long as this surface consisted of a relatively hard material, such as steel, for example, it was extremely difficult to make a spherical bearing surface, that is, to make a ball-like surface. Where there are irregularities, undesirable wear points appear. If this bearing surface is now formed by a plastics material, the creation of the ball-like form is quite radically simplified. Firstly, plastics materials can in many cases be machined better or with less effort than metals. Secondly, shaping in the case of plastics materials can in many cases be achieved by casting, which, although possible with metals, is not normally accompanied by the desired surface quality.

The plastics material is preferably arranged as a layer on a core of higher strength. The ball-and-socket joint has to transmit forces, in some cases considerable forces, so that the slide shoes are held with the necessary pressure force against the swash plate even during a suction stroke of several pistons. These forces require structural parts of correspondingly stable construction. Most plastics materials are not capable of transmitting these powerful forces without becoming deformed. If, on the other hand, a stable core having a layer, which can moreover be relatively thin, of friction-reducing plastics material is used, there is no need to fear deformation of the "ball". Deformation of the plastics material that may nevertheless occur is restricted to an extent that is still acceptable. There is virtually no change in strength, so that conventional machines can be converted if need be.

The core preferably consists of a metal, in particular steel. The necessary strength values and pressure resistances can be achieved with steel.

Advantageously, the layer is in the form of an injection-moulded part which is injection moulded onto the core. For that purpose, the core is positioned in an injection mould. The plastics material is injected. By this means, one achieves not only an accurately-fitted shaping of the plastics material layer, but in most cases also an intimately adhering or clinging bond between the core and the plastics material. This bond facilitates subsequent finishing. Injection moulding allows the desired spherical surface, that is, the ball-like surface required at least in sections, to be achieved with the necessary degree of accuracy.

In one construction, it is preferred for the plastics material to surround the core completely. This complete sheathing means that there are virtually no attackable areas at which hydraulic fluid could penetrate between the core and the plastics material, which under unfavourable circumstances leads to detachment of the plastics material from the core. Moreover, the plastics material on the core is fixedly held not only by the adhesive bond but also by the geometry. A positively-interlocked bond is produced.

In another construction, provision is made for the plastics material to be arranged only in a region which in operation is engageable by the pressure plate. This construction conserves plastics material, which may provide advantages in respect of costs. In most cases it is not necessary to sheathe the core completely with plastics material. Identical operational characteristics are achieved even if only a part is covered with plastics material, namely, that part where there is the risk that the pressure plate would otherwise rub directly against the core.

The core and/or the plastics material are preferably provided on their sides facing each other with at least one shaped configuration. Since this shaped configuration is limited to the side on which the core and the layer face each other, there are no adverse external effects. A connection, in many cases an interlocking engagement even, is achieved by this shaped configuration, which contributes to preventing displacement of core and plastics layer along their contact area. As the pressure plate pivots with respect to the core, shear forces, in some cases considerable shear forces, occur, which could contribute to the plastics material's being pushed out between the core and the pressure plate. The shaped configurations prevent this. The shaped configurations can, for example, be formed by bores or grooves into which the plastics material penetrates so that the plastics material remains, as it were, firmly clamped to the core.

In a preferred construction, however, provision is made for the shaped configuration on the core to be in the form of a projection which, at least in sections, is circumferential, and against which the edge of the plastics material lies. The plastics material is therefore held firmly at the location on the "ball-like surface" at which is it is provided. Possible displacements are prevented from the outset by the plastics material being fixedly held at its edge. This has the advantage that the plastics material need not be weakened at any point.

BRIEF DESCRIPTION OF THE DRAWING

The invention is described hereinafter with reference to a preferred embodiment in conjunction with the drawing, in which the single FIGURE shows a cross-section through a part of a hydraulic axial piston machine.

DESCRIPTION OF AN EXAMPLE EMBODYING THE BEST MODE OF THE INVENTION

A hydraulic axial piston machine 1 has a cylinder drum 2 which is arranged to rotate about an axis 3 relative to a swash plate 4.

In the cylinder drum 2 there are arranged several cylinders 5, only one of which is illustrated, with cylinder bushes 6, which could also be omitted if need be. In the cylinder 5 a piston 7 is arranged to move back and forth. In the FIGURE, the piston is illustrated in its innermost retracted position. The piston 7 is joined, articulated by means of a ball-and-socket joint 8, to a slide shoe 9. The slide shoe 9 lies against the swash plate 4.

So that the slide shoe is held in contact with the swash plate even when the piston 7 performs a suction stroke, that is, is moved to the left in the FIGURE, a pressure plate 10 which acts on the slide shoe 9 is provided. The pressure plate 10 in its turn is supported by way of a ball-and-socket joint 11 against the cylinder drum 2. The ball-and-socket joint 11 comprises a ball 12 which is pressed towards the swash plate 4 by means of a pin 14 loaded by a spring 13.

On the core 12, or more accurately on a part of the surface which in operation is covered over by the pressure plate as it pivots back and forth, there is provided a layer 15 of a friction-reducing plastics material. The plastics material is preferably selected from the group of high-strength thermoplastic plastics materials based on polyarylether ketones, in particular polyether ether ketones, polyamides, polyacetals, polyaryl ethers, polyethylene terephthalates, polyphenylene sulphides, polysulphones, polyether sulphones, polyether imides, polyamideimide, polyacrylates, phenol resins, such as novolak resins. Such plastics materials are able to co-operate with metals to provide relatively low friction even when there is no lubrication by oil.

In the ball-and-socket joint 11 there is therefore a material combination comprising a metal, namely, the material of the pressure plate 10, which is preferably made of steel, and the friction-reducing plastics material of the layer 15 on the core 12, which together form a "ball".

The core 12 is provided with a circumferential projection 16, which acts on the edge of the plastics layer 15. Even the pivoting movement of the pressure plate 10 is not able to displace the plastics material on the surface of the core 12.

The layer 15 is in the form of an injection-moulded part. It is injected directly onto the core 12 and has a thickness of 2.5 mm or less. To do this, the core 12 is placed in an injection mould and the plastics material is then injected. This in many cases saves complicated additional machining of the surface of the core 12. On the contrary, the desired accurate ball-like shape of the layer 15 can be achieved during the injection moulding and with an accuracy that can be achieved only with relatively expensive machines in the case of a metal-cutting shaping of the core 12.

The pressure plate 10 can likewise be manufactured with correspondingly little effort. It can be constructed in the manner known previously from the state of the art. Basically speaking, all that is necessary is to create the through-openings for the slide shoes 9 and the through-opening for receiving the shaft 17 of the cylinder drum 2. In many cases this can be done during manufacture of a base member for the pressure plate. The pressure plate 10 then only needs to be ground. Since the grinding is limited to relatively few, small areas, however, the effort involved in this is acceptable.

Just like the pressure plate 10, the core 12 consists of a solid material, preferably iron or even steel. Because the layer 15 of the friction-reducing plastics material is only relatively thin, it has no appreciable influence on the strength of the core and thus on the forces which can be transmitted through the ball-and-socket joint. Instead of steel, it is possible to use different plastics materials for the core 12. These plastics materials then no longer need to be selected from the point of view of friction reduction. The reduction in friction is effected by the layer 15. Of course, it is an advantage if a plastics material is so strong that it is able to transmit the required forces and yet still has comparable friction coefficients.

Instead of the core 12 being only partly covered, complete sheathing of the core 12 is also possible. In that case the projection 16 can possibly be omitted. The layer 15 is then held on the core in interlocking engagement therewith, the shaping of the core, for example, with flanks or projections 18, contributing to this.

The necessary pressure force with which the pressure plate 10 presses the slide shoes 9 against the swash plate 4 is transmitted to the pressure plate 10 by the springs 13 by way of the ball-and-socket joint 11. This pressure force is dependent on speed. The lower the speed of the machine, the less is the required pressure force. The pressure force must merely prevent the slide shoes 9 tilting or lifting away from the swash plate 4 in some other way. The increase in pressure force need not be linear. Thus, for example, when the speed doubles from 1,500 to 3,000 rev/min, the pressure force can increase threefold. Accordingly, an increase from 5 kg to 15 kg.

A machine that is designed for lower speeds can therefore be constructed with a weaker ball-and-socket joint 11. In that case, the core 12 can likewise be formed from the plastics material of the friction-reducing layer 15. At higher speeds, however, a stronger material is required.

We claim:

1. A hydraulic axial piston machine having a cylinder drum having at least one cylinder in which a piston is arranged to move back and forth, the piston bearing by means of a slide shoe against a swash plate, the cylinder drum and the swash plate being rotatable relative to one another, and including a pressure plate which holds the slide shoe in contact with the swash plate, the pressure plate being joined in an articulated fashion to the cylinder drum by means of a ball-and-socket joint bearing against the pressure plate through a convexly spherical bearing surface, the convexly spherical bearing surface being formed from a friction-reducing plastics material.

2. A machine according to claim 1, in which the plastics material is formed as a layer on a core made of higher strength material.

3. A machine according to claim 1, in which the core comprises metal.

4. A machine according to claim 2, in which the layer is an injection-moulded part which is injection moulded onto the core.

5. A machine according to claim 2, in which the plastics material completely surrounds the core.

6. A machine according to claim 2, in which the plastics material is located only in a region which is engageable by the pressure plate.

7. A machine according to claim 3, including at least one shaped configuration including at least one of the core and the plastics material on their sides facing each other.

8. A machine according to claim 7, in which the shaped configuration on the core comprises a projection which, at least in sections, is circumferential, and against which an edge of the plastics material lies.

* * * * *